US006156444A

United States Patent [19]

Smith et al.

[11] Patent Number: 6,156,444

[45] Date of Patent: Dec. 5, 2000

[54] STRUCTURE FOR AND METHOD OF MANUFACTURING AERODYNAMIC EXPANDED METAL

[75] Inventors: Warren F. Smith, Branford; Subin Roychoudhury; William C. Pfefferle, both of Madison, all of Conn.

[73] Assignee: Precision Combustion, Inc., New Haven, Conn.

[21] Appl. No.: 09/220,664

[22] Filed: Dec. 24, 1998

[51] Int. Cl.[7] ..... B21D 31/04; B01J 32/00; B01J 35/04

[52] U.S. Cl. ..... 428/596; 428/599; 29/6.1; 502/439; 502/527.19

[58] Field of Search ..... 428/596, 573, 428/599; 29/6.1, 6.2; 502/439, 527.24, 527.19

[56] References Cited

U.S. PATENT DOCUMENTS

| | | | |
|---|---|---|---|
| 2,751,978 | 6/1956 | Koskinen | 29/6.2 |
| 4,220,030 | 9/1980 | McDowell | 72/326 |
| 4,303,747 | 12/1981 | Bender | 29/6.1 |
| 4,883,510 | 11/1989 | Guisti et al. | 55/326 |
| 5,091,119 | 2/1992 | Biddulph et al. | 261/114.3 |

*Primary Examiner*—John J. Zimmerman
*Attorney, Agent, or Firm*—McCormick, Pauling & Huber LLP

[57] ABSTRACT

An expanded metal with an aerodynamic cross-section for use in high velocity fluid flows to decrease pressure drop. The expanded metal has a rhomboid cross-section with the acute angle of oriented into the flow. Also disclosed is a method of making the expanded metal.

8 Claims, 3 Drawing Sheets

STRUCTURE FOR AND METHOD OF MANUFACTURING AERODYNAMIC EXPANDED METAL

BACKGROUND OF THE INVENTION

1. Field of the Invention

This invention is a structure for expanded metal that creates an aerodynamic leading edge. A method is also provided for making the structure. In one specific application, the expanded metal is used as a substrate material for a catalyst in an automotive converter.

2. Brief Description of the Related Art

Expanded metal is an extremely versatile material structure. It is used in numerous applications from fascia panels, balcony railings, lawn furniture, enclosures, walkways, to supports for catalysts in automotive catalytic converters.

Expanded metal comes in two basic configurations, standard and flattened. In the standard configuration, a plate of metal is cut at an angle of 90 degrees to the surface and then expanded, by pulling, to form an aperture having the ubiquitous diamond shape. The standard process leads to an expanded metal that has a rectangular strand. The flattened configuration is the standard configuration with the further processing step of cold rolling. In the flattened configuration, the aperture remains diamond shaped and the strand cross-section remains rectangular.

Another common processing technique is stretching. In stretching, the metal is pulled after expansion with the goal of rotating the strands. The strands, however, after rotation still have a rectangular cross-section.

In yet another expanded metal configuration, the cross-section of the expanded metal is hexagonal with two acute angles. In this configuration the acute angles of the strand are oriented in the plane of the aperture.

As indicated above, expanded metal has numerous applications. In one particular category of uses the aerodynamic design of strand is becoming critical. Expanded metal has been used for years in applications where a fluid flows through the diamond shapes. As expanded metal is used in applications where the velocity of the fluid flow is becoming greater and greater the pressure drop created by the profile of the strand is becoming increasingly problematic.

Various solutions have been developed to reduce the pressure drop created by the profile of the strand. These solutions have focused on orienting the strand into the flow, as discussed above, or mounting the expanded metal in the fluid flow at an angle to in effect orient the strand into the flow. While these approaches do improve pressure drop characteristics, a strand with an essentially rectangular cross-section is still used. It would be desirable if the strand itself had a more aerodynamic cross-section.

SUMMARY OF THE INVENTION

It has now been found that expanded metal can be given a more aerodynamic shape by giving the strand an acute angle as a leading edge. By manipulating the angle at which the metal is cut prior to expansion, the cross-section of the strand can be manipulated. In the case of standard expanded metal, a change in the cutting angle would change the cross-section of the strand from a rectangle to a rhomboid with one of the acute angles of the rhomboid forming a leading edge for a fluid passing through an aperture.

An angle less than 90 degrees is critical to reducing the pressure drop for a fluid passing through expanded metal. If the leading edge to the flow stream is 90 degrees or more, the fluid flow becomes turbulent as the fluid parts as it goes around the strand. This effect can be minimized by orienting the strand such that one of the corners of the rectangular cross-section is forming a leading edge.

In the present invention, however, the rhomboid cross-section allows the incident angle to be less than 90 degrees. This reduced angle permits the flow either to remain laminar or for some length of the strand to remain laminar as the flow travels around the strand. As with other expanded metals, the leading edge can be rotated after expansion or the expanded metal can be mounted within the flow stream to further optimize the pressure drop.

If expanded metal of this design is employed as a catalyst support, the expanded metal would have to be made of materials suitable for the environment and be coated with appropriate support materials and catalysts to accomplish the desired chemical reactions. In this application a strand width up to twenty times the foil thickness is preferred. Within this range, increases in conversion are proportionally greater than corresponding increases in pressure drop. Above this range, conversion will increase, but the pressure drop increase is more closely proportional to the conversion increase.

DETAILED DESCRIPTION OF THE PREFERRED EMBODIMENTS OF THE INVENTION

Figure 1:
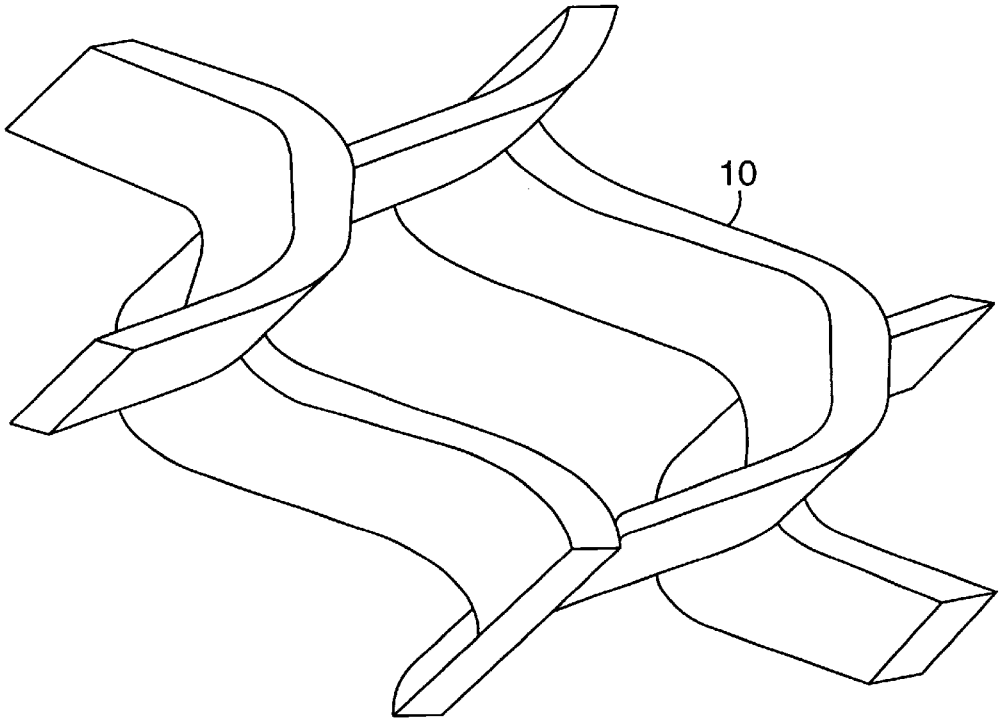
FIG. 1 is a perspective view of an aperture.
Figure 2:
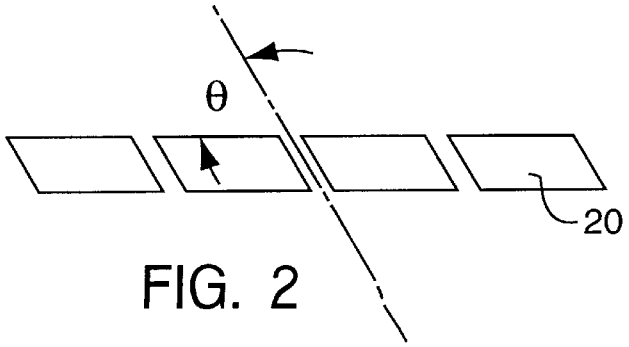
FIG. 2 is a side view depicting the angle of the slit cut into the metal sheet from which the aperture is made.

FIG. 1 is a perceptive view of an aperture defined by strands 10 in a sheet of expanded metal. The aperture is rhomboid shaped. The cross-section was formed by intermittently slitting a sheet of metal 20 at an acute angle θ to the surface, FIG. 2, and then stretching the metal 20 so the slit opened into the aperture. The strands 10 have a rhomboid cross-section oriented such that one acute angle of the rhomboid is positioned furthest from the place defined by the sheet.

Figure 3:
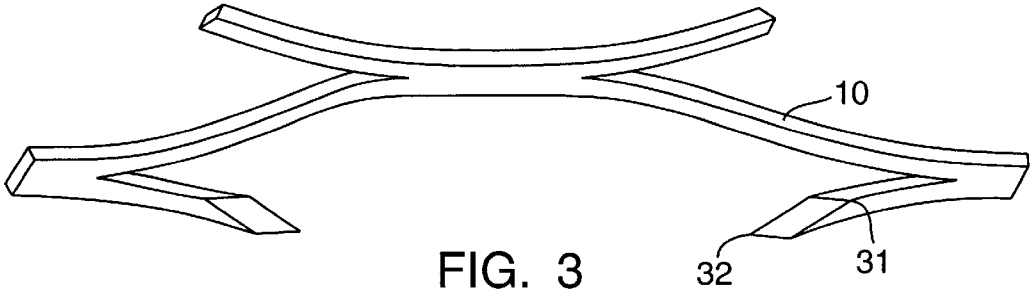
FIG. 3 is a perspective view missing a portion of a strand to show the cross-section of the strand.
Figure 4:
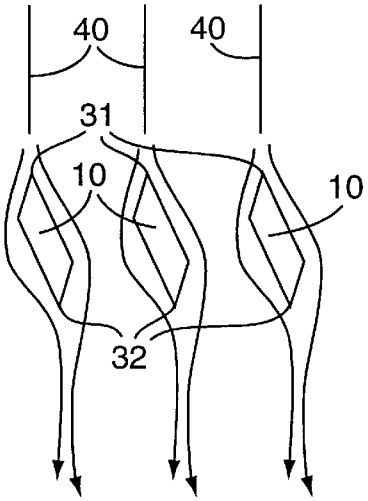
FIG. 4 is a side view of a series of apertures in a flow of fluid.
Figure 5:
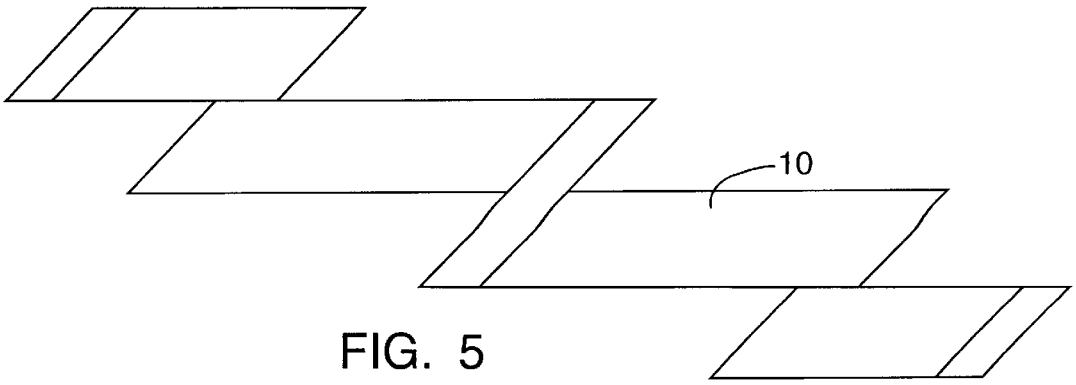
FIG. 5 is a side view of the expanded metal.

FIG. 3 is a perspective view of an aperture with a section removed to better show the cross-section. The strand 10 has a rhomboid cross-section oriented such that one of the acute angles forms an leading edge 31 for a fluid 40 entering the aperture and the other acute angle forms a trailing edge 32 for a fluid exiting the aperture, FIG. 4. The precise acute angle is determined by the application. When this expanded metal is used in a flow stream to decrease pressure drop the acute angle should be selected to provide laminar flow over the strand. In gaseous fluid flows such as air, an acute angle of between about 30 and 75 degrees can be used, with a preferred upper limitation of 60 degrees. Angles below 30 degrees would reduce the mechanical strength of the edge of the acute angle to an undesirable degree and present fabrication difficulties. Angles above 75 degrees only offer marginal pressure drop benefits. Angles between 30 and 60 degrees appear to offer the most benefit for pressure drop reduction without excessive loss of mechanical strength. It is preferred that the strand width be no greater than five times the sheet thickness, above this limit pressure drop increases resulting from the strand are not sufficiently offset by the reduced pressure drop of the cross-section. FIG. 5 is a side view of a section of a piece of expanded metal which has strands with a rhomboid cross-section.

Figure 6:
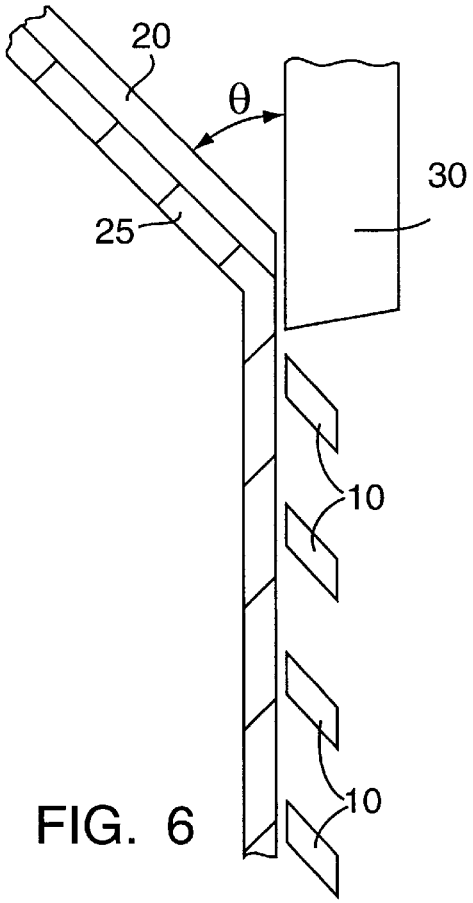
FIG. 6 is a side view of a machine to make the expanded metal of the present invention.

FIG. 6 is a side view of a machine with a cutting blade 30 for slitting and stretching a sheet of material to create the expanded metal of the invention. The support plate 25 and the cutting blade are sufficiently wide to accommodate a sheet of material. Further, cutting blade 30 is intermittent across the support plate such that the cutting blade makes intermittent slits in the material when it comes into contact with the material. The metal sheet 20 is placed on support plate 25. Support plate 25 is an angle (, the acute angle desired, relative to the cutting blade 30. As cutting blade 30 contacts metal sheet 20 a slit is made in the material, then the cutting blade stretches the material to form the aperture. By cutting the expanded metal at an acute angle the strand created will have a rhomboid cross-section with acute leading and trailing edges.

Figure 7:
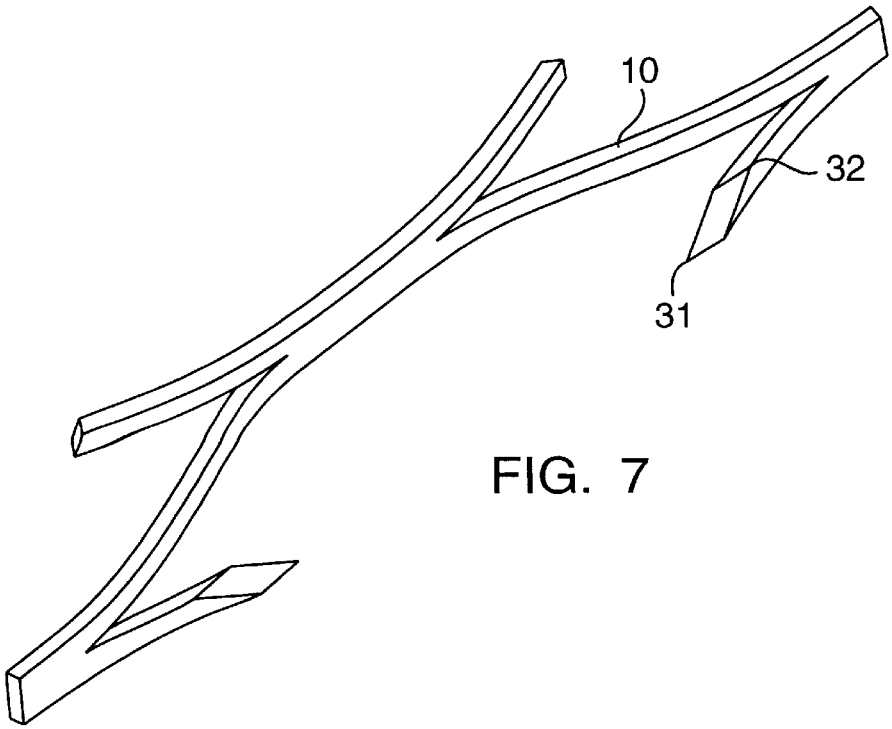
FIG. 7 is a perspective view of a representative aperture with a section removed to show the catalyst layer deposited thereon.

FIG. 7 is a perspective view of a representative aperture with a section removed to show the catalyst layer deposited thereon. The layer is deposited by methods well known in the art such as sputtering or dipping. The catalyst layer is composed of active components based on the chemical reaction desired and other inactive components.

What is claimed is:

1. An expanded metal comprising:

a single metal sheet slit intermittently at an acute angle to the surface of the metal sheet and stretched forming strands defining apertures and having a rhomboid cross-section oriented such that one acute angle of the rhomboid is positioned furthest from a plane defined by the sheet.

2. The expanded metal of claim 1 wherein the aperture is a diamond shape.

3. The expanded metal of claim 2 wherein the acute angle is between about 30 and 75 degrees.

4. The expanded metal of claim 1 wherein the acute angle is between about 30 and 75 degrees.

5. A method of making an aerodynamic expanded metal, said method comprising:

intermittently slitting a metal sheet at an acute angle to the surface of said metal sheet, then stretching said metal sheet to form a series of apertures.

6. The method of claim 5 wherein said acute angle is between about 30 and 75 degrees.

7. For a catalyst support having expanded metal as the substrate material onto which the other elements of the catalyst are deposited, the expanded metal comprising single metal sheet slit intermittently at an acute angle to the surface of the metal sheet and stretched forming strands defining apertures and having a rhomboid cross-section section oriented such that one acute angle of the rhomboid is positioned furthest from a plane defined by the sheet.

8. The catalyst support of claim 7 wherein the expanded metal has a strand width less than approximately five times the foil thickness.

* * * * *

UNITED STATES PATENT AND TRADEMARK OFFICE

CERTIFICATE OF CORRECTION

PATENT NO. : 6,156,444
DATED : December 5, 2000
INVENTOR(S) : Warren Smith et al.

It is certified that error appears in the above-identified patent and that said Letters Patent is hereby corrected as shown below:

Title Page,
Inventors section, "Subin Roychoudhury" and substitute -- Subir Roychoudhury --.

Title Page, Abstract:
Line 4, after "angle of", insert -- the rhomboid --.

Column 2,
Line 45, after "is", delete "perceptive" and substitute -- perspective --.
Line 52, after "from the", delete "place" and substitute -- plane --.
Line 57, after "forms", delete "an" and substitute -- a --.

Column 3,
Line 5, after "the sheet", delete "thickness, above" and substitute -- thickness. Above --.
Line 20, after "angle", delete "(" and substitute -- θ --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*